US006802300B2

(12) United States Patent
Dutt

(10) Patent No.: US 6,802,300 B2
(45) Date of Patent: Oct. 12, 2004

(54) STROKE-CONTROLLED VALVE AS A FUEL METERING DEVICE OF AN INJECTION SYSTEM FOR INTERNAL COMBUSTION ENGINES

(75) Inventor: Andreas Dutt, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 12 days.

(21) Appl. No.: 10/182,690

(22) PCT Filed: Nov. 16, 2001

(86) PCT No.: PCT/DE01/04306

§ 371 (c)(1),
(2), (4) Date: Dec. 6, 2002

(87) PCT Pub. No.: WO02/44548

PCT Pub. Date: Jun. 6, 2002

(65) Prior Publication Data

US 2003/0136385 A1 Jul. 24, 2003

(30) Foreign Application Priority Data

Nov. 30, 2000 (DE) ..... 100 59 424

(51) Int. Cl.[7] ..... F02M 37/04
(52) U.S. Cl. ..... 123/506; 123/510
(58) Field of Search ..... 123/450, 506, 123/459, 462, 510, 511, 514

(56) References Cited

U.S. PATENT DOCUMENTS 2,918,048 A * 12/1959 Aldinger et al. ..... 123/459
4,530,337 A * 7/1985 Laufer ..... 123/506
5,125,807 A * 6/1992 Kohler et al. ..... 417/490
5,186,151 A * 2/1993 Schwerdt et al. ..... 123/506
5,357,933 A * 10/1994 Kasahara et al. ..... 123/506
6,045,120 A * 4/2000 Tarr et al. ..... 251/282

FOREIGN PATENT DOCUMENTS

| | | |
|---|---|---|
| WO | WO 92 07182 | 4/1992 |
| WO | WO 97 40272 | 10/1997 |
| WO | WO 98 49441 | 11/1998 |
| WO | WO 00 34647 | 6/2000 |
| WO | WO 00 53920 | 9/2000 |

* cited by examiner

*Primary Examiner*—Mahmoud Gimie
(74) *Attorney, Agent, or Firm*—Kenyon & Kenyon

(57) ABSTRACT

A lift-controlled valve as a fuel metering device of an injection system for internal combustion engines has a valve needle which may be actuated axially against the resistance of a spring, the valve needle being situated in a graduated coaxial recess in a valve body and interacting with a valve seat formed in the recess of the valve body in this case controlling the fuel injection process; the valve has in addition a high-pressure area which is connected to an assigned injection nozzle and which is located upstream from the valve seat, a low-pressure area which is located downstream from the valve seat and which opens out into a fuel return flow, and a low-pressure equalizing piston which coaxially adjoins the valve and which is fixedly connected to the valve needle. The characterizing feature is that a first control edge is formed on the low-pressure equalizing piston, the control edge interacting with a second control edge on the valve body recess in the area of the fuel return flow or in such a way that a throttle cross-section which is dependent on the valve lift is formed between the two control edges.

6 Claims, 2 Drawing Sheets

STROKE-CONTROLLED VALVE AS A FUEL METERING DEVICE OF AN INJECTION SYSTEM FOR INTERNAL COMBUSTION ENGINES

FIELD OF THE INVENTION

The present invention relates to a lift-controlled valve.

BACKGROUND INFORMATION

The valve seat of the fuel metering device of modem valve-controlled fuel injection systems, diesel injection systems in particular, is exposed to a very high thermal load. Opening the valve completes the injection and the fuel under high pressure is diverted into the return flow via the open valve seat. The pressure energy of the fuel is for the most part converted into thermal energy. This results in the fuel and the surrounding components being very severely heated. Severe thermal expansions of the components resulting from this change the working clearances of the moved components to a corresponding degree. At the same time, the leakage characteristics are changed and accordingly the entire function of the injection system. In an extreme case, the working clearance between the moved components may be reduced to zero. The consequence is jamming or wear in the form of welding of the moved components, resulting in a complete failure of the injection system.

Known high-pressure valves of diesel injection systems have a low-pressure equalizing piston located in the low-pressure area in the cutoff flow direction downstream from the valve seat, the purpose of the low-pressure equalizing piston being to avoid pressure surges on the bottom of the valve needle which occur during valve switching operations.

Such undesirable pressure surges would otherwise bring about a malfunction of the valve needle movement caused by undefined forces. In known valves of the type under discussion, the low-pressure equalizing piston forms an annular gap between the valve needle and the valve body, the angular gap developing a permanent, unchangeable throttling effect, as a result of which a consistent quantity of fuel is withdrawn from the injection system.

The overflow quantity flowing off through the annular gap is continuously replaced by fuel flowing back into the cutoff area (low-pressure area), the fuel thus cooling the high-pressure and filling area of the injection system. The fuel permanently withdrawn via the annular gap flows back into the fuel tank via the return flow.

The object of the present invention is to improve the cooling effect while retaining the total overflow quantity.

SUMMARY OF THE INVENTION

According to the present invention, the object is achieved in a lift-controlled valve.

The present invention is based on the idea of draining an increased fuel quantity from the cutoff area into the return flow via the annular gap under discussion when, and only when, the fuel in the cutoff area has been heated to a maximum. This is the case immediately after the opening of the valve seat and the associated cutoff of the fuel under high pressure. This results in an improved cooling of the filling area and cutoff area and a simultaneous increase in the efficiency of the entire injection system.

In addition, the improved cooling reduces the introduction of heat into the components of the valve and thus minimizes the thermal expansion of the components. As a result it is accordingly possible to improve the functional reliability since the working clearances of the moved components of the valve remain more dimensionally stable in operation.

DETAILED DESCRIPTION

Figure 1:
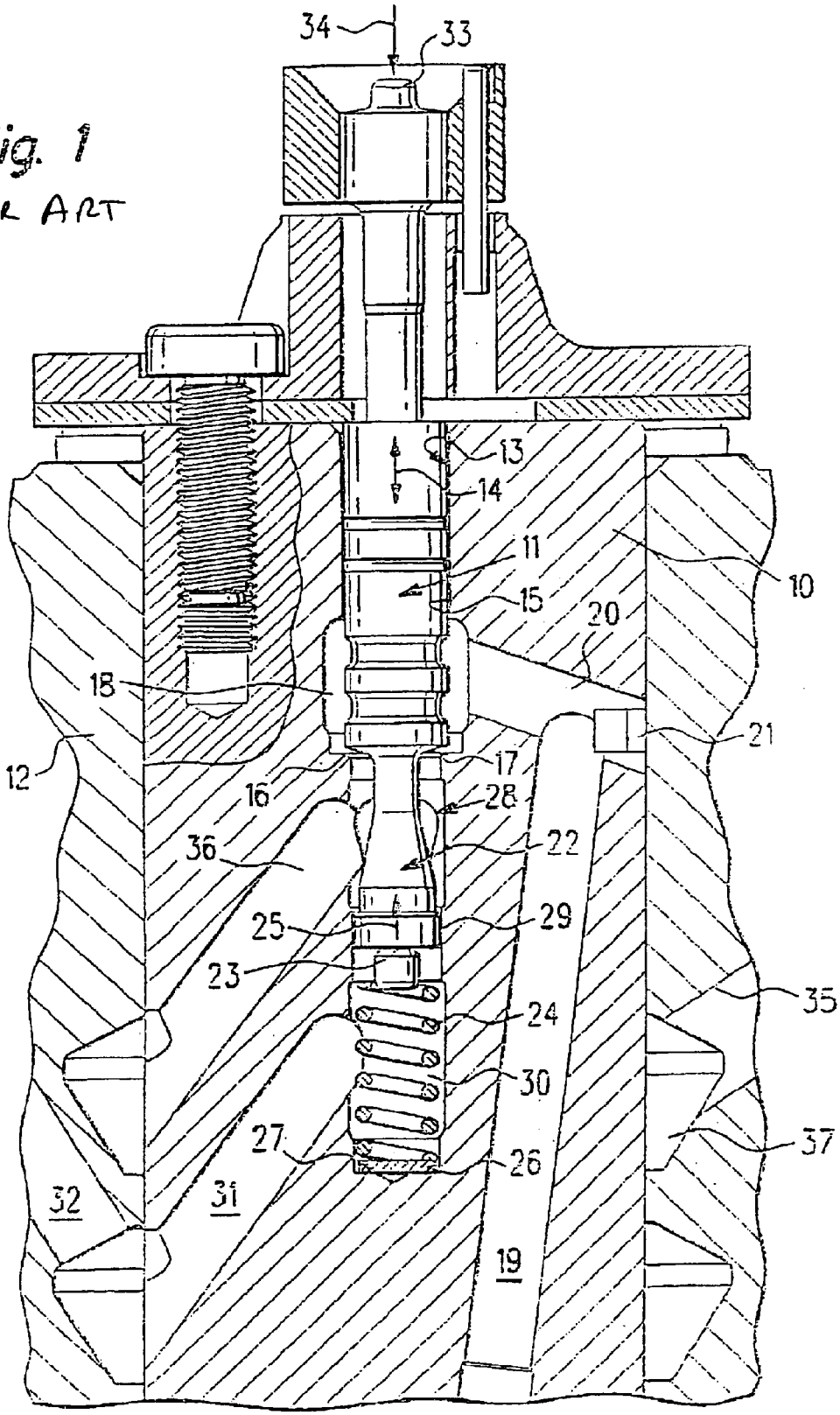
Fig. 1 PRIOR ART
FIG. 1 shows a lift-controlled valve (according to the related art), i.e., with an annular gap acting as a constant throttle, in a vertical longitudinal section and greatly enlarged.

The reference symbol 10 denotes a valve body and 11 denotes a valve needle of a lift-controlled valve as a fuel metering device of an injection system for internal combustion engines. Valve body 10 is integrated in a pump body 12 of an injection pump (which is otherwise not shown). Valve needle 11 is arranged to be movable in axial direction 14 in a coaxial recess 13 in valve body 10, the diameter of the coaxial recess changing a plurality of times. An upper area of recess 13 identified as 15 is used as a guide bore for valve needle 11.

A valve cone 16 is formed on valve needle 11, the valve cone interacting with a valve seat 17 which is incorporated into valve body 10, i.e., into recess 13.

Valve cone 16 and valve seat 17 form a lift-controlled valve for directing the high-pressure fuel stream to an assigned (not shown) injection nozzle of the fuel injection system. For this purpose, recess 13 is expanded into a pressure chamber 18 in the area of valve cone 16 and valve seat 17, fuel under high pressure being delivered to pressure chamber 18 via channels 19, 20. Fuel is distributed to the injection nozzle (not shown) via a distributor slot 21.

Valve cone 16 is adjoined by a low-pressure equalizing piston which is joined in one piece with valve needle 11 and identified in its entirety as 22, a compression spring 24 applying force axially (in direction of arrow 25) to (lower) face 23 of low-pressure equalizing piston 22. In the opposite direction, compression spring 24 is supported on bottom 27 of recess 13 via a disk 26.

A shaped area 28 of recess 13 below valve seat 17 functions as a low-pressure area and is connected hydraulically to a return flow 30 extending in the area of compression spring 24 via an annular gap 29 between low-pressure equalizing piston 22 and recess 13. From return flow 30, the fuel is returned to the fuel tank (not shown) via channels 31 and 32 in valve body 10 and in pump body 12, respectively.

Valve 16, 17 is actuated at upper end 33 of valve needle 11 in direction of arrow 34, i.e., against the resistance of compression spring 24. A pressure magnet may be used, for example, as an actuating element of valve needle 11, the design and function of the pressure magnet being known, for which reason it is not shown.

Given the structural and hydraulic conditions described above, a fuel metering device of this type operates as follows. In order to deliver fuel under high pressure to the assigned injection nozzle (not shown), valve cone 16 is in contact with valve seat 17, the valve thus being closed. Opening valve 16, 17 terminates the injection process. The fuel located under high pressure in pressure chamber 18 now flows into low-pressure area 28 of recess 13 via open valve seat 17, the fuel expanding and most of its pressure energy being converted into thermal energy. A portion of the heated fuel reaches return flow 30 via annular gap 29 and from there it is returned to the fuel tank (not shown) via channels 31, 32. The fuel quantity drained off via annular gap 29 is replaced by a corresponding quantity of fuel having a cool temperature which is delivered to low-pressure area 28 via channels 35, 36 which are connected hydraulically by an annular channel 37. The hot fuel remaining in low-pressure area 28 is cooled correspondingly as are the components of the valve surrounding low-pressure area 28.

A disadvantage in the design according to FIG. 1 is the fact that angular gap 29—irrespective of the respective position of valve needle 11—always has a constant cross-section so that it operates only as a constant throttle.

Figure 2:
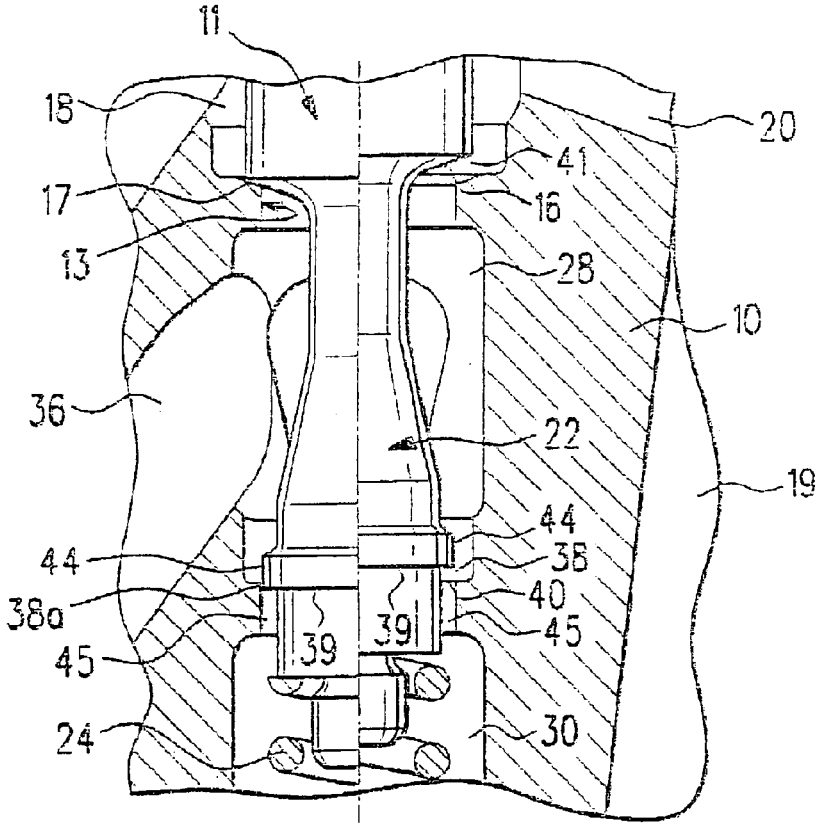
FIG. 2 shows an embodiment of the lift-controlled valve according to the present invention in a (partial) depiction according to FIG. 1.
Figure 3:
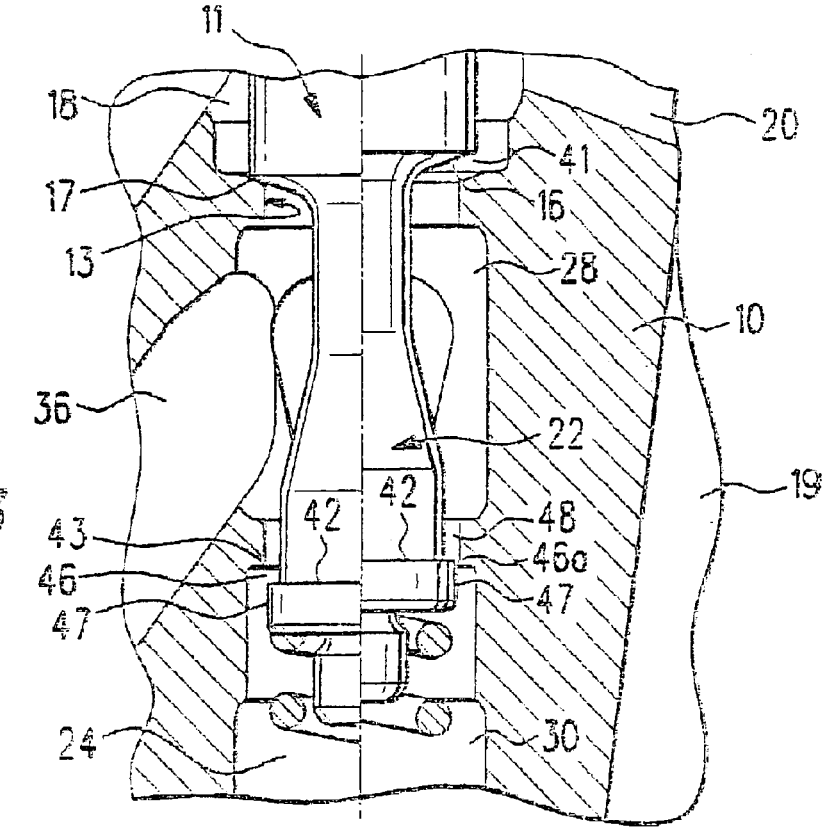
FIG. 3 shows another embodiment of the lift-controlled valve according to the present invention in a depiction according to FIG. 2.

The embodiments according to the present invention according to FIGS. 2 and 3 create an effective remedy. For the sake of clarity, the components in FIGS. 2 and 3 corresponding to the design according to FIG. 1 are identified with the same reference symbols as in FIG. 1.

The embodiment according to FIG. 2 of the lift-controlled valve according to the present invention is distinguished from the design according to FIG. 1 by a valve-needle lift-controlled cross-section 38 or 38*a* which is defined by a first control edge 39 on low-pressure equalizing piston 22, which is joined in one piece with valve needle 11, and by a second control edge 40 on valve body 10.

Control edges 39, 40 are precisely positioned with respect to valve cone 16 and valve seat 17, respectively, so that a throttle cross-section dependent on valve lift 41 is formed between control edges 39,40. This is made apparent by comparing throttle cross-sections 38 and 38*a* with valve 16, 17 open (right half of FIG. 2) and with valve 16, 17 closed (left half of FIG. 2). Accordingly, throttle cross-section 38 attains a maximum with valve 16, 17 open, while it is reduced to a minimum 38*a* with valve 16, 17 closed. The throttle cross-section (38, with valve 16, 17 open) is first determined by the axial spacing of the two control edges 39 and 40. If the two control edges 39, 40 finally overlap—with movement of the valve needle in the closing direction, the throttle cross-section is now determined by an annular gap (see reference symbol 38*a*, with valve 16, 17 closed, left half of FIG. 2) extending between the circumferential surface of low-pressure equalizing piston 22—at 44—and the circumferential surface of recess 13 in drain area 45.

With valve 16, 17 open, it is thus possible to drain off a substantially larger quantity of heated fuel from low-pressure area 28 via throttle cross-section 38 into return flow 30 than with valve 16, 17 closed. Correspondingly, it is possible to deliver a considerably larger quantity of cool fuel to low-pressure area 28 with valve 16, 17 open than with valve 16, 17 closed, as a result of which the cooling effect with respect to the components surrounding low-pressure area 28 is changeable corresponding to the current demand.

In the embodiment according to FIG. 3 a first control edge 42 is formed on low-pressure equalizing piston 22 and a second control edge 43 is formed on valve body 10. In contrast to the embodiment according to FIG. 2, first control edge 42 faces valve cone 16 while second control edge 43 faces away from valve seat 17. In this case also, the throttle cross-section (46, in this case with valve 16, 17 closed) is first determined by the axial spacing of the two control edges 42, 43.

If valve needle 11 (and thus also low-pressure equalizing piston 22 correspondingly) moves into the open position of valve 16, 17 (see right half in FIG. 3), control edges 42, 43 overlap. Throttle cross-section 46*a* is determined in this case by the circumferential surface of low-pressure equalizing piston 22—at 47—and the circumferential surface of recess 13 in drain area 48, thus representing a narrow annular gap. In the embodiment according to FIG. 3, a substantially larger quantity of heated fuel is drained off from low-pressure area 28 into return flow 30 via throttle cross-section 46 with valve 16, 17 closed than with valve 16, 17 open, which is the reverse of the case with the embodiment according to FIG. 2. Correspondingly, it is possible to deliver a considerably larger quantity of cool fuel to low-pressure area 28 with valve 16, 17 closed than with valve 16, 17 open.

The variant that is advantageous (the embodiment according to FIG. 2 or the embodiment according to FIG. 3) depends on the pressure characteristic and the switching characteristics of the valve in the specific individual case.

In both cases, valve-needle lift-controlled low-pressure cross-section 38 or 46 (be it according to FIG. 2 or FIG. 3) makes it possible to withdraw in a targeted manner the hot fuel cutoff quantity from the filling and cutoff space (low-pressure area 28) into return flow 30. Valve-needle lift-controlled overlap length 38*a* (FIG. 2) or 46*a* (FIG. 3) forms a lift-controlled throttle by the resulting annular gap between valve needle 11 and valve body 10. It is possible to coordinate both valve-needle lift-controlled cross-sections (38 and 46) to the switching characteristics of the valve in such a way that the maximum cooling of the filling and cutoff area (low-pressure area 28) is achieved with minimum leakage into return flow 30.

What is claimed is:

1. A lift-controlled valve as a fuel metering device of an injection system for an internal combustion engine, comprising:

a valve body having a graduated coaxial recess;

a valve seat formed in the graduated coaxial recess;

a spring;

a valve needle that is actuated axially against a resistance of the spring, the valve needle being situated in the graduated coaxial recess and interacting with the valve seat in order to control a fuel injection process;

a high-pressure area connected to an assigned injection nozzle and located upstream from the valve seat;

a low-pressure area located downstream from the valve seat opening out into a fuel return flow; and a low-pressure equalizing piston that coaxially adjoins the valve, the low-pressure equalizing piston being fixedly connected to the valve needle, wherein:

a first control edge is formed on the low-pressure equalizing piston, the first control edge interacts with a second control edge on the graduated coaxial recess in an area of the fuel return flow in such a way that a throttle cross-section that is dependent on a lift is formed between the first control edge and the second control edge, and the first control edge and the second control edge are coordinated in such a way that the throttle cross-sectional area reaches a maximum value with the valve closed and a minimum value with the valve open.

2. The lift-controlled valve according to claim 1, wherein:

the low-pressure equalizing piston includes a collar of an enlarged diameter, on a lower side of which facing away from the valve seat the first control edge is formed, and the graduated coaxial recess includes a graduated narrowing of the enlarged diameter, on an upper end of which facing the valve seat the second control edge is formed.

3. The lift-controlled valve according to claim 1, wherein:

the throttle cross-section is determined by a gap height between the first control edge and the second control edge at an end position of the valve needle and by an annular gap at another end position of the valve needle.

4. The-lift-controlled valve according to claim 3, wherein:

annular gap is located at an overlap of a circumferential surface of a collar of the low-pressure equalizing piston with an internal circumference of a drain area of the valve body.

5. A lift-controlled valve as a fuel metering device of an injection system for an internal combustion engine, comprising:

a valve body having a graduated coaxial recess;

a valve seat formed in the graduated coaxial recess;

a spring;

a valve needle that is actuated axially against a resistance of the spring, the valve needle being situated in the graduated coaxial recess and interacting with the valve seat in order to control a fuel injection process;

a high-pressure area connected to an assigned injection nozzle and located upstream from the valve seat;

a low-pressure area located downstream from the valve seat opening out into a fuel return flow; and a low-pressure equalizing piston that coaxially adjoins the valve, the low-pressure equalizing piston being fixedly connected to the valve needle, wherein:

a first control edge is formed on the low-pressure equalizing piston, the first control edge interacts with a second control edge on the graduated coaxial recess in an area of the fuel return flow in such a way that a throttle cross-section that is dependent on a lift is formed between the first control edge and the second control edge, and the first control edge and the second control edge are coordinated in such a way that the throttle cross-sectional area reaches a minimum value with the valve closed and a maximum value with the valve open.

6. The lift-controlled valve according to claim 5, wherein:

the low-pressure equalizing piston includes a collar of an enlarged diameter, on an upper side of which facing the valve seat the first control edge is formed, and the graduated coaxial recess includes a graduated narrowing of the enlarged diameter, on a lower end of which facing away from the valve seat the second control edge is formed.

* * * * *